United States Patent [19]

Toryu et al.

[11] 4,000,436

[45] Dec. 28, 1976

[54] GASEOUS DISCHARGE LUMINOUS DEVICE

[75] Inventors: Takao Toryu, Chigasaki; Akiyasu Kagami, Ninomiya; Takashi Hase, Kamakura; Junro Koike, Machida; Tetsuo Sakai, Tokyo; Hiroshi Murakami, Yokohama; Iwao Oishi, Kawasaki, all of Japan

[73] Assignee: Dai Nippon Toryo Co., Ltd., Tokyo, Japan

[22] Filed: Jan. 30, 1976

[21] Appl. No.: 653,777

Related U.S. Application Data

[63] Continuation-in-part of Ser. No. 474,512, May 30, 1974, abandoned.

[30] Foreign Application Priority Data

May 31, 1973 Japan ..... 48-61132

[52] U.S. Cl. ..... 313/487; 313/185; 313/214; 313/226

[51] Int. Cl.[2] ..... H01J 61/06; H01J 61/16; H01J 61/44

[58] Field of Search ..... 313/486, 487, 224, 226, 313/223, 184, 185, 214

[56] References Cited

UNITED STATES PATENTS

| | | | |
|---|---|---|---|
| 1,186,993 | 6/1916 | Keyes | 313/223 X |
| 2,207,174 | 7/1940 | Jenkins | 313/487 |
| 2,357,732 | 9/1944 | Ehrlich | 313/487 |
| 2,409,769 | 10/1946 | Leyshon | 313/226 X |
| 2,622,221 | 12/1952 | Beese | 313/486 |
| 3,589,789 | 6/1971 | Hubert et al. | 313/485 X |
| 3,599,028 | 8/1971 | Wanmaker et al. | 313/486 |
| 3,686,686 | 12/1969 | Hall | 315/169 R X |

*Primary Examiner*—Palmer C. Demeo

[57] ABSTRACT

A luminous device includes a cell, electrodes having a discharge gap of from 0.1 to 3.0 mm, a phosphor and a gas at a pressure of 30 to 300 nm, the gas having discharge emission spectra below 200 nm. The phosphor is one of various cerium activated yttrium silicates or europium activated orthophosphates and is disposed in the cell for exposure to the emission discharge of the gas. The device gives off blue light with higher emission efficiency and chroma saturation.

14 Claims, 8 Drawing Figures

A : EUROPIUM ACTIVATED BARIUM ORTHOPHOSPHATE

B : EUROPIUM ACTIVATED STRONTIUM ORTHOPHOSPHATE

C : CERIUM ACTIVATED YTTRIUM SILICATE

D : SELF-ACTIVATED CALCIUM TUNGSTATE

A : EUROPIUM ACTIVATED BARIUM ORTHOPHOSPHATE

B : EUROPIUM ACTIVATED STRONTIUM ORTHOPHOSPHATE

C : CERIUM ACTIVATED YTTRIUM SILICATE

D : SELF-ACTIVATED CALCIUM TUNGSTATE

⊗ : CHROMARITY OF NTSC BLUE COLOR PRIMARY

1 : CHROMARITY OF CERIUM ACTIVATED YTTRIUM SILICATE EMISSION

2 : CHROMARITY OF EUROPIUM ACTIVATED STRONTIUM ORTHOPHOSPHATE EMISSION

3 : CHROMARITY OF EUROPIUM ACTIVATED BARIUM ORTHOPHOSPHATE EMISSION

4 : CHROMARITY OF SELF-ACTIVATED CALCIUM TUNGSTATE EMISSION

A : EUROPIUM ACTIVATED BARIUM ORTHOPHOSPHATE

B : EUROPIUM ACTIVATED STRONTIUM ORTHOPHOSPHATE

C : CERIUM ACTIVATED YTTRIUM SILICATE

D : SELF-ACTIVATED CALCIUM TUNGSTATE

GASEOUS DISCHARGE LUMINOUS DEVICE

CROSS-REFERENCE TO RELATED APPLICATION

This application is a continuation-in-part of Ser. No. 474,512 filed May 30, 1974, and now abandoned.

BRIEF SUMMARY OF THE INVENTION:

This invention relates to gas discharge luminous devices, and particularly to gas discharge luminous devices suitable for use as miniature light sources (e.g. miniature lamps) or panels to display images including characters or figures, said devices emitting blue light or a mixture of primary lights comprising blue light caused by the excitation of a phosphor with ultraviolet rays given off by gas discharge. This invention is characterized by a new combination between the gas for the gas discharge sealed in the device and the phosphor.

In the conventional well-known fluorescent lamp commonly used as light sources, a phosphor is excited with ultraviolet rays given off by a gas discharge to yield luminescence. This luminescence is caused by the excitation of the phosphor by the ultraviolet rays having a wavelength of 253.7 nm, the main emission of mercury vapor discharge. However, a light source in the shape of a miniature lamp or an image display is essentially characterized in the small dimension of the discharging device, and hence the discharging gap must be limited within about 2–3 mm. In such case, the gas must be sealed, according to Paschen's law (a well-known law in the field of discharge physics), at a increased pressure of more than 100 Torr. The saturated vapor pressure of mercury is low at an ordinary temperature, that is, $10^{-3}$ Torr or less at 15° C and $10^{-2}$ Torr. or less at 40° C. Accordingly, if mercury is sealed along with a gas such as argon, the proportion of mercury in vapourous atom is extremely small and the utilization of emission caused thereby is almost in valid. In the manufacture of such discharging device, most attempts have therefore been made to seal in the device rare gases such as helium, neon, argon, krypton or xenon, hydrogen, nitrogen or proper mixtures thereof in order to easily obtain an elevated pressure higher than 100 Torr at an ordinary temperature and to utilize the emissions given off by such gases.

It must be further stated that the wavelengths of the ultraviolet rays given off by the simple substances or mixtures mentioned above are in many cases shorter than 200 nm, that is, they have powerful emission spectra in the so-called vacuum ultraviolet region.

Self-activated calcium tungstenate and lead activated calcium tungstenate are the best known of the phosphors which emit blue light due to the excitation by ultraviolet rays. The emission efficiencies of these phosphors are, however, fairly low when the excitation is by ultraviolet rays of wavelengths shorter than 200 mm, although the efficiencies are sufficiently high with respect to the excitation by the 253.7 nm ultraviolet rays given by mercury discharge. These phosphors suffer further disadvantages in that the colors emitted thereby are not sufficiently pure to be adopted as the blue color primary for a display panel of color television.

The phosphors according to the present invention have not so far attracted public attention as materials usable in discharging devices since their emission efficiencies are extremely low when they are excited by ultraviolet rays having a wavelength of 253.7 nm. The present inventors however discovered that these materials are extremely superior to self-activated calcium tungstenate or lead activated calcium tungstenate not only in emission efficiency but also in color purity as blue color primary.

The object of this invention is to provide gas discharge luminous devices comprising new combinations of the phosphors materials and the gases to be sealed in the devices which give very powerful discharge emissions particularly in the vacuum ultraviolet region.

DETAILED DESCRIPTION OF THE INVENTION

Ultraviolet rays are given off by glow discharge of various gases. Among these, Table 1 shows the wavelengths at which the intensities of the rays are particularly powerful.

Table 1

| Gas | Wavelength of powerful emission in ultraviolet region (nm) | | | |
|---|---|---|---|---|
| Helium | 58.4 | 59.2 | 58 – 110 | (continuous spectra) |
| Neon | 73.6 | 74.3 | 74 – 100 | (continuous spectra) |
| Argon | 104.8 | 106.7 | 105 – 155 | (continuous spectra) |
| Krypton | 116.5 | 123.6 | 125 – 180 | (continuous spectra) |
| Xenon | 129.6 | 147.0 | 148 – 200 | (continuous spectra) |
| Hydrogen | 121.6 | 161.6 | Many line spectra around 160 | |
| Nitrogen | 100 – 150 (Many line spectra) | | | |

Figure 1:
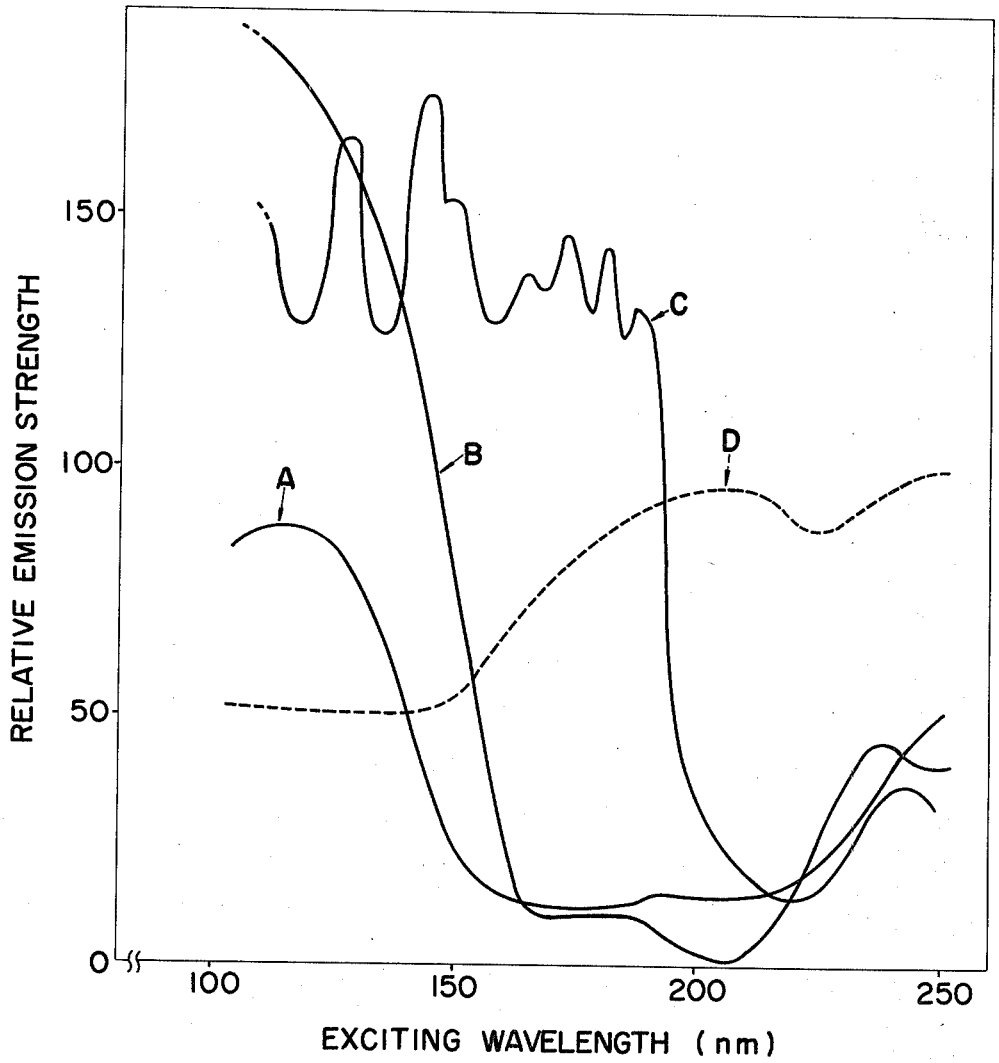
FIG. 1 shows the excitation spectra of the three of the phosphors to be used in the gas discharge luminous devices according to the present invention, and of self-activated calcium tungstate.

In FIG. 1 are summarized the excitation spectra of self-activated calcium tungstenate, which has been conventionally known as a phosphor which emits blue light when excited by ultraviolet rays, and of three phosphors to be used in the present invention, cerium activated yttrium silicate, europium activated strontium orthophosphate and europium activated barium orthophosphate. The measurements of the excitation spectra were carried out by means of a vacuum spectroscope, the relative emission intensities being expressed in terms of the ratios of the individual intensities to those of sodium salicylate powder. It is noted that excitation characteristics of the phosphors to be used in the present invention are remarkable in the vacuum ultraviolet region.

In Table 2 are given the suitable combinations of the gases conductive to the emission of the ultraviolet rays and the phosphors as determined from a consideration of their features as are shown in Table 1 and FIG. 1.

Table 2

| Main gases contributive to emission of ultraviolet rays | Phosphor |
|---|---|
| Helium | Europium activated strontium orthophosphate |
| Neon | Europium activated strontium orthophosphate |
| Argon | Europium activated strontium orthophosphate, Cerium activated yttrium silicate, Europium activated barium orthophosphate |
| Krypton | Europium activated strontium orthophosphate, Cerium activated yttrium silicate |
| Xenon | Cerium activated yttrium silicate |
| Hydrogen | Europium activated strontium orthophosphate Cerium activated yttrium silicate |
| Nitrogen | Europium activated barium orthophsphate, Europium activated strontium orthophosphate, Cerium activated yttrium silicate |

The evaluation shown in Table 2 was not possible until the present inventors determined theretofore unknown excitation spectra of the phosphors with the vacuum ultraviolet rays and actually confirmed them by the experiments with discharge cells. In Table 2 are shown the gases which contribute to the emission of the ultraviolet rays. However, the actual gases to be sealed in the gas discharge luminous devices may be a simple gas, or mixtures such as given in Table 3, taking the firing potential or the discharge stability into account.

It was confirmed by the experiments that the phosphors shown in Table 2 efficiently luminesce by the discharges with the single gases in Table 2 and with the mixed gases in Table 3 as well.

Table 3

| Main gases contributive to emission of ultraviolet rays | Practically available gas mixture |
|---|---|
| Helium | |
| Neon | Helium + Neon<br>Neon + Argon |

Table 3-continued

| Main gases contributive to emission of ultraviolet rays | Practically available gas mixture |
|---|---|
| Argon | Helium + Argon |
| Krypton | Neon + Krypton<br>Helium + Krypton |
| Xenon | Neon + Xenon<br>Helium + Xenon<br>Helium + Argon + Xenon |
| Hydrogen | Argon + Hydrogen<br>Helium + Hydrogen<br>Neon + Hydrogen |

Examples are given in Table 3 for the mixtures of two gases. The combinations of three or more gas may, of course, be applicable as far as they efficiently give off ultraviolet rays of wavelengths shorter than 200 nm.

Figure 7:
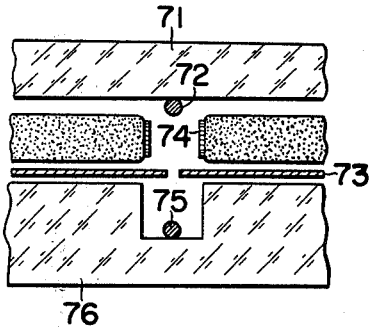

Experiments with a D.C. gas discharge display panel of multi-layer type such as illustrated in FIG. 7 show that the luminous efficiency of any phosphor of the present invention is 3 to 6 times as high as that of self-activated calcium tungstenate when simple argon (Ar) or the mixed gas of argon and hydrogen ($Ar + H_2$, $H_2$ 0.5–10%) is applied as a gas to be sealed in the device.

Comparative experiments were carried out on the phosphors of the present invention and the most common conventional phosphor, self-activated calcium tungstenate, with the results given in Table 4.

Table 4

| GAS | | Helium (He) | Argon (Ar) | Helium-Xenon (He - Xe) | Neon-Xenon (Ne - Xe) | Helium-Krypton (He - Kr) |
|---|---|---|---|---|---|---|
| Applicable ranges of compositions | | | | Xe: 0.1–10% | Xe: 0.1–10% | Kr: 0.1–10% |
| Conditions for measurements | Composition<br>Total pressure | 150 Torr | 40 Torr | Xe: 1%<br>150 Torr | Xe: 1%<br>150 Torr | Kr: 0.7%<br>150 Torr |
| Phosphor | Self-activated calcium tungstate | 1<br>(0.003) | 1<br>(0.03) | 1<br>(0.08) | 1<br>(0.09) | 1<br>(0.05) |
| | Cerium activated yttrium silicate | 12.5<br>(0.038) | 7.0<br>(0.21) | 3.0<br>(0.24) | 1.8<br>(0.16) | 4.8<br>(0.24) |
| | Europium activated strontium orthophosphate | 10.0<br>(0.03) | 7.5<br>(0.23) | 2.2<br>(0.18) | 1.2<br>(0.11) | 4.9<br>(0.25) |
| | Europium activated barium orthophosphate | 2.7<br>(0.008) | 4.0<br>(0.12) | 0.9<br>(0.07) | — | 2.5<br>(0.13) |

Figure 8:
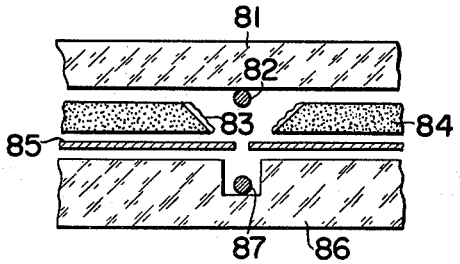
FIG. 8 shows the construction of the discharge cell used in the present invention.

The construction of the discharge cell used in the experiments is illustrated in FIG. 8, in which 81 is a front-plate, 82 is a wire-like anode, and 84 is a ceramic centre sheet whose holes slope with an inclination angle of 45° with respect to the inside surface which is coated with a fluorescent material 83. Having the feature that the hole of the ceramic centre sheet slopes with respect to the inside surface coated with the phosphor, the discharge cell as used in the present invention has a wider, legible emitting surface than a conventional discharge cell. The further advantage of such a construction is that the fluorescent surface has less tendency to degrade. 85 indicates a plate cathode, 86 a back-plate, and 87 an auxiliary anode. The gas is injected into the interior of the cell at a desired total or partial pressure. A direct current voltage is impressed across the anode 82 and the cathode 85, the resultant glow discharge producing the ultraviolet rays which excite the phosphor and cause it to emit. The emission is determined by a photometric means placed close to the plate 81. The photometric data are treated in such a manner that the relative strength of the emission is calculated in terms of emission power in accordance with spectral response characteristics, the emission power being divided by the electric input into the cell to give the emission efficiency. A panel comprising at least 5 identical cells is manufactured, the individual inside surfaces of four of the cells are coated with self-activated calcium tungstenate ($CaWO_4$), cerium activated yttrium silicate ($Y_2SiO_5$:Ce), europium activated strontium orthophosphate ($Sr_3(PO_4)_2$: Eu), europium activated barium orthophosphate ($Ba_3(PO_4)_2$:Eu), respectively, and the remaining cell is not coated with any phosphor. The gas is sealed in the cell at a specified pressure and composition. Then each cell is operated to determine overall emission coefficiency for emission of each phosphor.

In Table 4, the overall emission efficiencies are shown for the emissions produced by the phosphors when they are combined with the gases of various compositions, the efficiencies being normalized by the data for the calcium tungstenate material. It must be added that the emission quantity of the cell not coated with phosphor is substracted from the emission data for each cell.

Examples of the conditions for the measurements are given in the Table. However, there were found no noticeable differences in the operabilities of the cells insofar as the gases fell with the ranges of the compositions given in the Table, and the cells worked satisfactorily as discharging cells. The values in ( ) indicate the absolute values of the overall emission efficiency (%.*w*/*w*). Argon of about 1% may be added as a Penning's gas in order to improve discharge characteristics of the mixtures of helium-xenon (He—Xe) and of neon-xenon (Ne—Xe). In addition, a slight amount of mercury may be added to the gases to prevent the spattering of the electrodes.

From the emission efficiencies in Table 4, it can be clearly understood that remarkable improvements in the capacity to emit can be accomplished by the use of a phosphor according to the present invention combined with simple argon, simple helium, helium-xenon mixture, neon-xenon mixture or helium-krypton mixture. In addition to helium and neon, which are given in Table 4 as diluent gases, argon, hydrogen or nitrogen may be used for the improvement in the emission capacity. Furthermore, cerium activated yttrium silicate containing small quantities of barium, calcium or magnesium can be used as a phosphor according to the present invention. Cerium activated yttrium silicate to which a proper quantity of barium is added has an advantage that the emission spectra is extended to longer wavelengths with improved visible efficiency. Europium activated strontium orthophosphate or europium activated barium orthophosphate with addition of a small quantity of calcium, and europium activated strontium barium otrhophosphate can be used as phosphors of the present invention.

Table 5 shows the overall emission efficiencies of cerium activated yttrium silicate and self-activated calcium tungstenate obtained by changing the composition of the gas, the discharge gap, and the product of *p* (pressure) and *d* (discharge gap). In the table the data for cerium activated yttrium silicate are normalized by those for self-activated calcium tungstenate and the normalized values are shown along with the absolute values of the overall emission efficiencies as indicated in parentheses.

Table 5

| | Gas Composition | d:discharge gap (mm) | Pd product (Torr.mm) | Self-activated calcium tungstenate | Cerium-activated yttrium Silicate |
|---|---|---|---|---|---|
| A | He+Xe Xe;2% | 0.25 | 50 | 1 (0.08) | 1.9 (0.15) |
| B | He+Xe Xe;2% | 1.0 | 100 | 1 (0.11) | 1.5 (0.17) |
| C | He+Kr Kr;0.7% | 1.5 | 225 | 1 (0.05) | 4.8 (0.24) |
| D | Argon | 1.5 | 60 | 1 (0.03) | 7.0 (0.21) |
| E | He+Kr Kr;6% | 2.0 | 200 | 1 (0.06) | 4.5 (0.27) |

Figure 5:
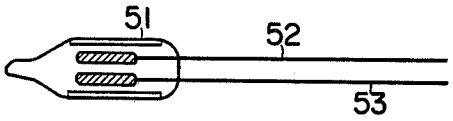
FIG. 5 illustrates the construction of a miniature light source shaped as a miniature lamp of the diode discharge-tube type.

The data given in Table 5 were determined in almost the same manner as those in Table 4. The data in column B are those obtained for commercial fluorescent miniature lamps as illustrated by FIG. 5, the inside surface of the tube being coated with a phosphor. The other data are those obtained for the gas discharge cells whose constructions are illustrated in FIG. 7 or FIG. 8.

From the data on the overall emission efficiencies given in Table 5 it is seen that employment of cerium activated yttrium silicate results in remarkable improvement in the performance of a gas discharge luminous device whose discharge gap (*d*) is in the range of 0.25 to 2.0 (mm) and whose product of pressure and discharge gap (pd product) is in the range of 50 to 225 (Torr.mm). Further, it can be easily estimated from the results given in Table 4 that any of the other phosphors falling inside the scope of the present invention will produce a gas discharge luminous device under the similar conditions as cerium activated yttrium silicate does.

Table 5 shows examples where a mixture of helium-xenon or helium-krypton, or argon are employed as the gas to be sealed in the device. Other gases such as those given in Table 2 or Table 3 can, of course, be employed, in mixtures or alone, to improve the emission performance of a gas discharge luminous device, insofar as the discharge gap (*d*) is specified to be in the range of 0.1 to 3.0 (mm) and the pd product in the range of 30 to 300 (Torr.mm).

Figure 2:
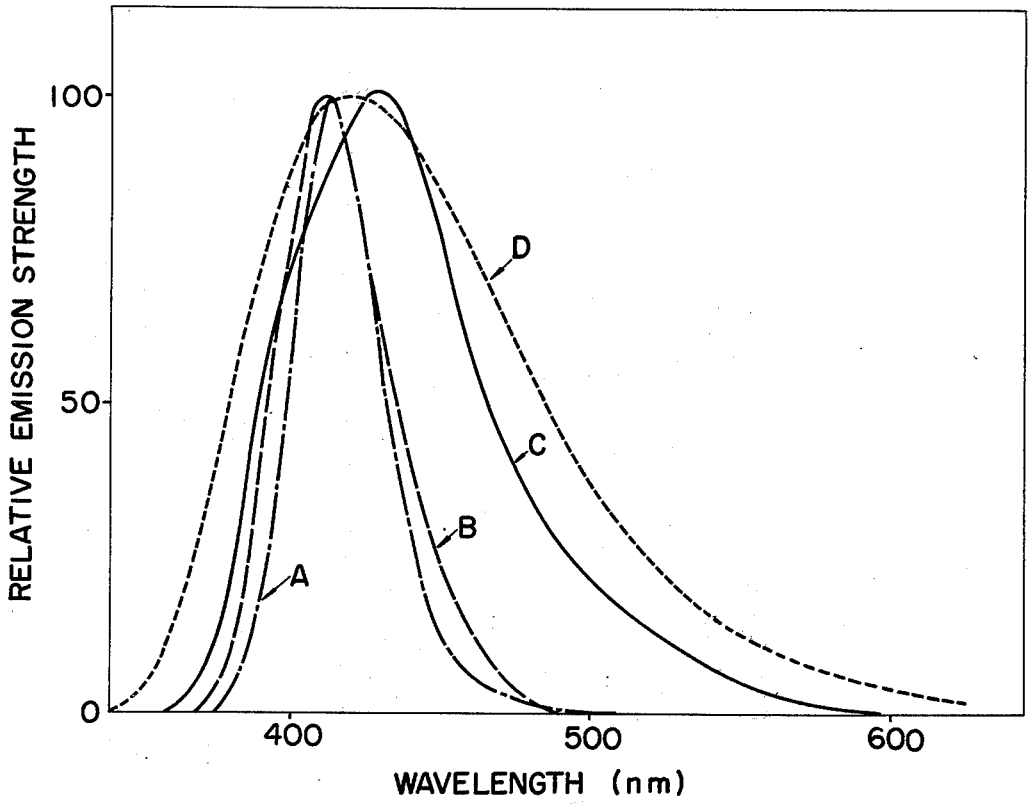
FIG. 2 shows the emission spectra of the three of the phosphors to be used in the gas discharge luminous devices according to the present invention, and of self-activated calcium tungstate.
Figure 3:
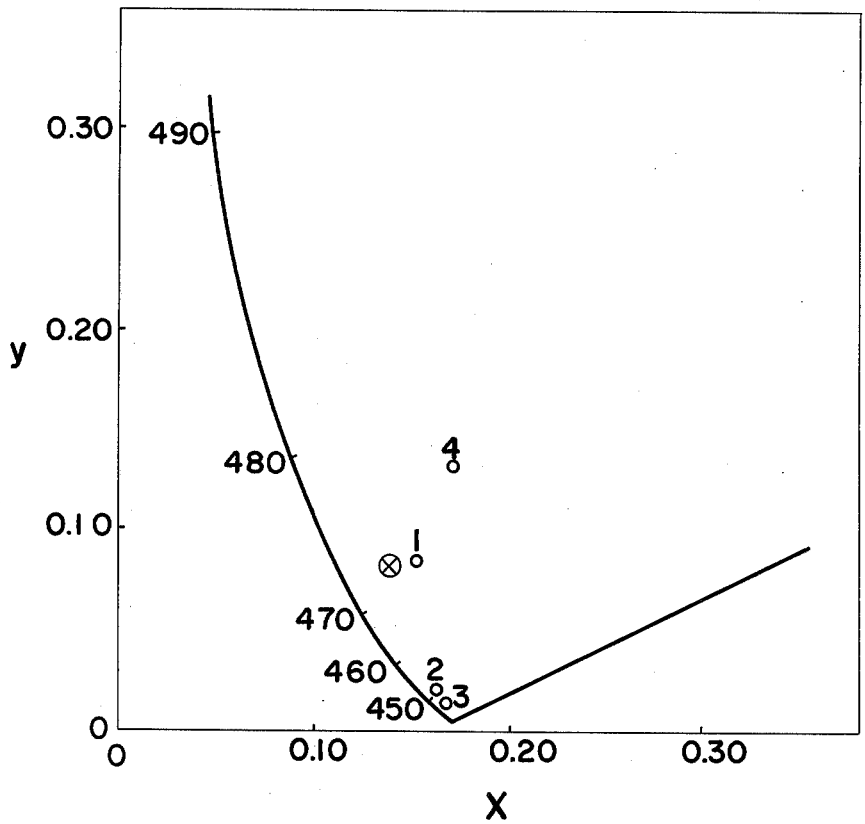
FIG. 3 shows the chromaticity diagram of the three of the phosphors to be used in the gas discharge luminous devices according to the present invention, and of self-activated calcium tungstate.

FIG. 3 illustrates the plots for CIE chromaticity calculated from the emission spectra with the phosphors of the present invention and self-activated calcium tungstate given in FIG. 2. It is apparent from FIG. 3 that the chromaticity of emission with cerium activated yttrium silicate is much closer to the chromaticity of the blue primary used in the NTSC color television system than that of any conventional combinations using self-activated calcium tungstate, and this fact results in color reproduction of higher fidelity. It is further seen that europium activated strontium orthophosphate and europium activated barium orthophosphate have higher saturations and are advantageously applied as color picture displays for constructing a picturing system with a wide range of color reproducibility. The gas discharge luminous device of the present invention, having improved color purity and luminous efficiency, can be combined with conventional gas discharge luminous devices which respectively emit red light and green light in order to construct the display panel of a color television with a wider range of color reproducibility.

Figure 4:
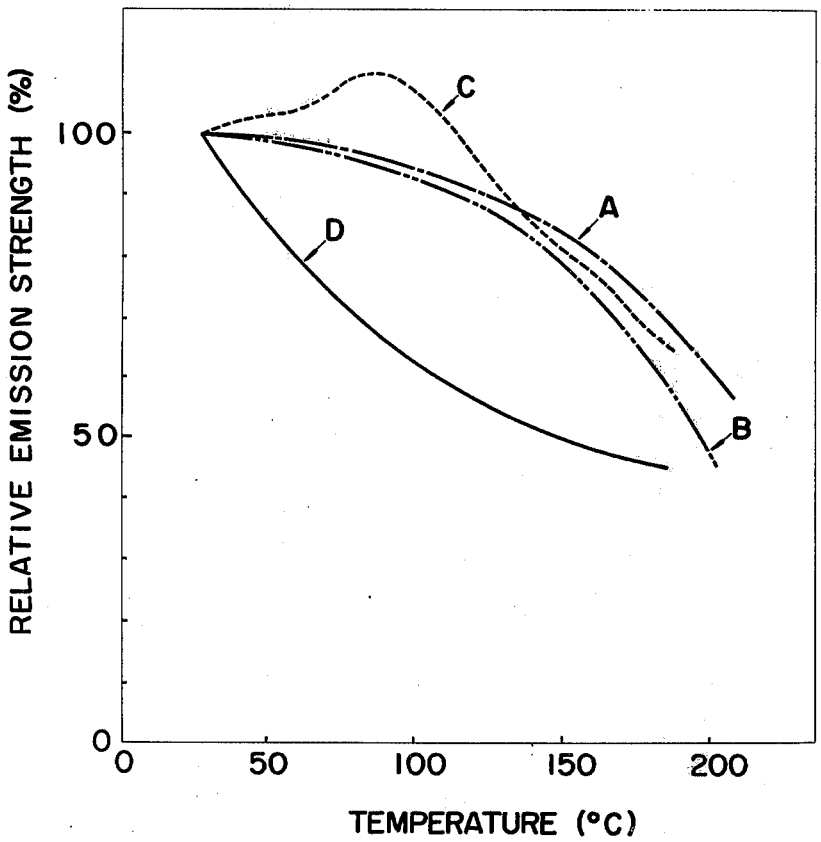
FIG. 4 shows the temperature dependencies of the emission efficiencies of the three of the phosphors to be used in the gas discharge luminous devices according to the present invention, and of self-activated calcium tungstate.

FIG. 4 shows the temperature dependencies of the emission efficiencies of the phosphor of the present invention and self-activated calcium tungstenate.

Since the temperature of a phosphor is estimated at about 100° C as is in the display panel with gas discharge luminescence, the temperature dependence is one of the most important factors for practical purposes. All phosphors of the present invention show far less temperature dependence of emission efficiency than the self-activated calcium tungstate conventionally used. In addition, the phosphors of the present invention possess excellent emission efficiencies at higher temperatures. These matters confirm that the phosphors of the present invention are highly suitable for a picture display apparatus to which the inventors intend.

Figure 6:
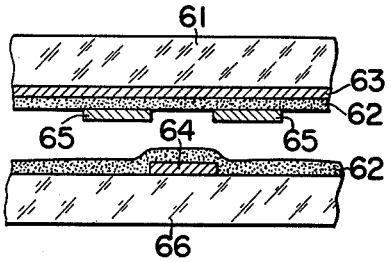
FIG. 6 and FIG. 7 show the constructions of the conventional gas discharge luminous devices for display panels.

As embodiments of the gas discharge luminous devices by the combination of a gas to fill the device and a phosphor described above, are exemplified a miniature light source shaped as a miniature lamp of the diode discharge tube type, whose construction is shown in FIG. 5, and a gas discharge luminous display panel of the plate-constructing type which comprises placing a number of luminous elements in a matric, whose construction is shown in FIG. 6 or FIG. 7.

FIG. 5 illustrates a construction a commercial fluorescent lamp, the inside surface of the tube being coated with a phosphor 51. The application of a voltage across the two wire-like electrodes 52, 53, placed in the middle of the tube generates a discharge, and the ultraviolet rays given off by the discharge excite the phosphor and cause it to fluoresce.

FIG. 6 shows an example of the construction of an A.C. voltage is impressed between the matrix electrodes 63 and 64 coated with dielectric layer 62, ultraviolet rays are given off by the discharge produced through the crossing space of the electrodes to excite a phosphor 65 coated on the substrates in the vicinity of the crossing area of the electrodes and to cause it to fluoresce. The numerals 61 and 62 denote the substrates.

FIG. 7 is to illustrate the construction of a gas discharge display panel developed by Borroughs Co., in which ultraviolet rays given off by glow discharge generated through the cell space between a display anode 72 and a cathode 73, the latter being crossed with the former, excite a phosphor coated on a centre sheet and cause it to fluoresce. The numeral 75 indicates a auxiliary electrode, and 71 shows a substrate. The panels described above are all well known. However, the construction of a discharge device or the portion coated with a phosphor are not limited to these examples.

The present invention is based on the discovery that the specified phosphors can be efficiently excited by the ultraviolet rays of wavelengths shorter than 200 mm.

The present invention provides gas discharge luminous devices which emit blue light with high emission efficiencies. However, the phosphors of the present invention may be used in combination with other types of phosphors in order to create a three-color picture element as light sources for displaying the additive color mixture of three color primaries; the latter include phosphors for emitting red light such as europhium activated yttrium vanadate ($YVO_4$:Eu) or europium activated yttrium oxide ($Y_2O_3$:Eu) and phosphors for emitting green light such as manganese activated zinc silicate ($Zn_2SiO_4$:Mn). Such combination may be carried out by placing the latter phosphors in the cells of the same construction as the cells used in the present invention and injecting the gases of the compositions as given in Table 3. A gas discharge panel of good characteristics for displaying colored pictures can be thus manufactured.

It must be further stated that the alteration in the hue and the chroma saturation can be easily accomplished by the method of the additive color mixture of the visible light given off by the glow discharge itself (if the light is powerful) and the blue light given off by the phosphor of the present invention. It is a matter of course that extensive alteration in the hue and chroma saturation is also possible by the method of the additive color mixture, which comprises the combination of the phosphors of the present invention and other phosphor to give off light other than the light by the phosphors of the present invention.

According to the present invention, it is possible to realize a blue-color light source with higher emission efficiency and chroma saturation. The present invention has extensive industrial applications: The discharge device of the present invention displays the blue-color primary with high emission efficiency and chroma saturation when applied to a gas discharge display panel to display colored pictures. It can be also applied as a light source with high emission efficiency to expose a recording material or a printing material which is highly sensitive to light of wavelengths in the regions of blue to nearultraviolet.

What is claimed is:

1. A gas discharge luminous device which comprises:
   a. a cell, said cell containing
   b. a gas having discharge emission spectra in a wavelength region of shorter than 200 nm,
   c. discharging electrodes operable to generate a discharge emission in said gas in a wavelength region of shorter than 200 nm, said discharging electrodes being constructed in such a configuration that the discharge gap is in the range of 0.1 to 3.0 mm and said gas being sealed in said cell at such a pressure that the product of said discharge gap and said pressure is in the range of 30 to 300 Torr.mm, and
   d. at least one blue light emitting phosphor selected from a group consisting of cerium activated yttrium silicate, cerium activated yttriun barium silicate, cerium activated yttrium calcium silicate, cerium activated yttrium magnesium silicate, europium activated strontium orthophosphate, europium activated strontium calcium orthophosphate, europium activated strontium barium orthophosphate, europium activated barium orthophosphate, and europium activated barium calcium orthophosphate, said phosphor being disposed in said cell for exposure to said discharge emission.

2. A gas discharge luminous device according to claim 1 in which the cell contains a single gas selected from a group consisting of helium, neon, argon, krypton, xenon, hydrogen, and nitrogen.

3. A gas discharge luminous device according to claim 2 in which the single gas is helium, and the blue light emitting phosphor is at least one selected from the group consisting of cerium activated yttrium silicate, europium activated strontium orthophosphate, and europium activated barium orthophosphate.

4. The gas discharge luminous device according to claim 2 in which the single gas is argon, and the blue light emitting phosphor is at least one selected from the group consisting of cerium activated yttrium silicate, europium activated strontium orthophosphate, and europium activated barium orthophosphate.

5. The gas discharge luminous device according to claim 2 in which the single gas is neon, and the blue light emitting phosphor is at least one selected from the group consisting of cerium activated yttrium silicate, europium activated strontium orthophosphate, and europium activated barium orthophosphate.

6. The gas discharge luminous device according to claim 2 in which the single gas is krypton, and the blue light emitting phosphor is at least one selected from the group consisting of cerium activated yttrium silicate, europium activated strontium orthophosphate and europium activated barium orthophosphate.

7. The gas discharge luminous device according to claim 2 in which the single gas is xenon, and the blue light emitting phosphor is at least one selected from the group consisting of cerium activated yttrium silicate, europium activated strontium orthophosphate and europium activated barium orthophosphate.

8. The gas discharge luminous device according to claim 2 in which the single gas is hydrogen, and the bluelight emitting phosphor is at least one selected from the group consisting of cerium activated yttrium silicate, europium activated strontium orthophosphate and europium activated barium orthophosphate.

9. The gas discharge luminous device according to claim 2 in which the single gas is nitrogen, and the bluelight emitting phosphor is at least one selected from the group consisting of cerium activated yttrium silicate, europium activated strontium orthophosphate or europium activated barium orthophosphate.

10. The gas discharge luminous device according to claim 1 in which the cell contains a gas mixture composed of at least two gases selected from the group consisting of helium, neon, argon, krypton, xenon, hydrogen, and nitrogen.

11. The gas discharge luminous device according to claim 1 in which the cell contains a gas mixture composed of from 99.9 to 10.0% by volume of a first gas selected from the group consisting of helium, neon, argon and nitrogen, and the balance being second different gas selected from the group consisting of argon, xenon and krypton.

12. The gas discharge luminous device according to claim 11 in which the gas mixture is composed of helium and xenon, and the bluelight emitting phosphor is at least one selected from the group consisting of cerium activated yttrium silicate, europium activated strontium orthophosphate, and europium activated barium orthophosphate.

13. The gas discharge luminous device according to claim 11 in which the gas mixture is composed of neon and xenon, and the bluelight emitting phosphor is at least one selected from the group consisting of cerium activated yttrium silicate, europium activated strontium orthophosphate, and europium activated barium orthophosphate.

14. The gas discharge luminous device according to claim 11 in which the gas mixture is composed of helium and krypton, and the bluelight emitting phosphor is at least one selected from the group consisting of cerium activated yttrium silicate, europium activated strontium orthophosphate, and europium activated barium orthophosphate.

* * * * *

UNITED STATES PATENT OFFICE

CERTIFICATE OF CORRECTION

Patent No. 4,000,436 Dated December 28, 1976

Inventor(s) Takao Toryu et al.

It is certified that error appears in the above-identified patent and that said Letters Patent are hereby corrected as shown below:

On the Title Page, Item [73] should read;

--- Dai Nippon Toryo Co., Ltd., Osaka-shi, Japan and Nippon Hoso Kyokai, Tokyo, Japan, part interest each ---.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*